US007758458B2

(12) United States Patent
Fujisawa et al.

(10) Patent No.: US 7,758,458 B2
(45) Date of Patent: Jul. 20, 2010

(54) BALL

(75) Inventors: Michinori Fujisawa, Okayama (JP); Sadahiro Ishii, Osaka (JP); Taketoshi Saeki, Hiroshima (JP)

(73) Assignees: Kuraray Co., Ltd., Kurashiki-shi (JP); Mikasa Corporation, Hiroshima-shi (JP)

( * ) Notice: Subject to any disclaimer, the term of this patent is extended or adjusted under 35 U.S.C. 154(b) by 466 days.

(21) Appl. No.: 11/547,131

(22) PCT Filed: Apr. 1, 2005

(86) PCT No.: PCT/JP2005/006495

§ 371 (c)(1),
(2), (4) Date: Mar. 23, 2007

(87) PCT Pub. No.: WO2005/097269

PCT Pub. Date: Oct. 20, 2005

(65) Prior Publication Data

US 2007/0219028 A1 Sep. 20, 2007

(30) Foreign Application Priority Data

Apr. 9, 2004 (JP) ..... 2004-115487

(51) Int. Cl.
*A63B 41/08* (2006.01)

(52) U.S. Cl. ..... 473/597; 473/604

(58) Field of Classification Search ..... 473/569, 473/573, 574, 594, 595, 596, 603–605
See application file for complete search history.

(56) References Cited

U.S. PATENT DOCUMENTS

| | | | | |
|---|---|---|---|---|
| 2,494,806 | A * | 1/1950 | Gibson | 473/596 |
| 2,931,653 | A | 4/1960 | Gow et al. | |
| 3,256,019 | A | 6/1966 | Barton | |
| 4,000,894 | A * | 1/1977 | Butzen | 473/596 |
| 4,570,931 | A * | 2/1986 | Martin | 473/596 |
| 4,928,962 | A * | 5/1990 | Finley | 473/596 |
| 4,991,842 | A * | 2/1991 | Finley | 473/596 |
| 5,310,178 | A * | 5/1994 | Walker et al. | 473/605 |
| 5,431,393 | A | 7/1995 | Wang | |
| 5,518,234 | A | 5/1996 | Palmquist | |
| 5,669,838 | A * | 9/1997 | Kennedy et al. | 473/596 |
| 6,024,661 | A * | 2/2000 | Guenther et al. | 473/605 |
| 6,283,881 | B1 | 9/2001 | Feeney | |
| 2004/0142780 | A1 * | 7/2004 | Estefano | 473/604 |
| 2006/0105866 | A1 * | 5/2006 | Ma | 473/603 |
| 2007/0117662 | A1 * | 5/2007 | Ma | 473/604 |

FOREIGN PATENT DOCUMENTS

| | | |
|---|---|---|
| JP | 2000 273769 | 10/2000 |
| JP | 2000 328465 | 11/2000 |

* cited by examiner

*Primary Examiner*—Steven Wong
(74) *Attorney, Agent, or Firm*—Oblon, Spivak, McClelland, Maier & Neustadt, L.L.P.

(57) ABSTRACT

The present invention provides a gas filling-type ball for sports which has excellent non-slip property and sufficient mechanical strength such as surface abrasion resistance, and which can be particularly suitably used in a field of a material for a ball such as a basketball, American football, or rugby ball. The present invention relates to a ball used for any one of basketball, handball, rugby ball, and American football, comprising a sheet having formed thereon a cover layer including substantially continuous pebbles and hemispherical valleys adjoining the pebbles formed on a surface of a base fabric, in which: a height difference between the pebbles and the valleys is 50 to 1,000 μm, a vertical projected area of each of the adjoining valleys is 3 to 30 $mm^2$, and an average distance between the valleys is 0.5 to 3 mm.

7 Claims, No Drawings

BALL

TECHNICAL FIELD

The present invention relates to a ball for any one of basketball, handball, rugby ball, and American football. The present invention more specifically relates to a ball which has sufficient surface abrasion resistance, excellent cushioning property, and excellent non-slip property, and which is suitably used for basketball, handball, rugby ball, or American football.

BACKGROUND ARTS

Various properties are required for a ball such as a basketball, handball, rugby ball, or American football. For example, surface abrasion resistance at high level is required for a surface material subjected to repeated rubbing or collision with a hand, a floor, or the like. Further, in a case where a ball is brought into direct contact with a hand, soft cushioning property is required for reducing impact on fingertips in catching of the ball.

Various methods have been hitherto proposed as a method of obtaining a ball having cushioning property.

For example, there are proposed: a leather-like sheet at least including 4 layers of a nonporous elastic polymer layer (first layer), a porous elastic polymer layer (second layer), a layer formed of an elastic polymer and a nonwoven fabric (third layer), and a nonwoven fabric layer (fourth layer); and a ball formed of the leather-like sheet (see Patent Document 1). However, in a method of Patent Document 1, the first and second layers were formed by using elastic polymers each having durability for practical use to provide a ball which had insufficient cushioning property and which could not be suitably used as a ball for sports such as basketball.

Further, there is proposed synthetic leather having a transparent nonporous layer containing polyurethane as a main ingredient laminated on a surface of a base fabric covered with a polyurethane layer and having a pattern of pebbles and valleys. The synthetic leather has an air layer between the valleys and the nonporous layer, and a total area of bonding parts between the pebbles and the nonporous layer accounts for 50 to 90% of a surface area of the synthetic layer (see Patent Document 2). However, even in Patent Document 2, a ball having both cushioning property and durability for practical use and used as a ball handled by a hand such as a basketball has not yet been obtained.

A ball such as a basketball requires non-slip property to improve usability. There is proposed a basketball with excellent non-slip property including 9 to 12 cover panels and groove forming members for joining the cover panels on an outer surface of a ball main body (see Patent Document 3). However, sufficient non-slip property is hardly obtained because an area ratio of the groove forming members is small at joining parts of the cover panels in Patent Document 3.

Further, there is proposed a basketball having numerous polygonal recesses on an outer surface (see Patent Document 4). However, such polygonal recesses cause a ball formed of a sheet containing a base fabric to have poor softness, cushioning property, and feel. Further, the ball has problems in that abrasion resistance in collision with a ground is reduced and that a ball surface gets dirty easily.

In addition, there is proposed a basketball having numeral specific dimples on an outer surface (see Patent Document 5). According to Patent Document 5, the dimples have a height difference between projections and recesses of 200 to 500 μm, a vertical projected area of each of adjoining recesses of 79 to 314 $mm^2$ (diameter of 10 to 20 mm), and an average distance between the recesses of 8 to 16 mm (5/16 to 5/8 inches). However, such large dimples cause a ball formed of a sheet containing a base fabric to have problems such as reduced abrasion resistance, and poor cushioning property and non-slip property.

Further, there is proposed a sweat-absorbing ball material having a wet-coagulated polyurethane cover layer laminated on a surface of a polyurethane-impregnated fibrous material, in which the cover layer has a plurality of projecting pebbles and valleys between the pebbles on the surface thereof, and side surfaces of the pebbles are perforated (see Patent Document 6). However, the material of Patent Document 6 gets dirty easily, and dirt accumulates in use over a long period of time, to thereby significantly deteriorate a non-slip effect, impede its use, and provide insufficient cushioning property.

Therefore, a ball having sufficient surface abrasion resistance, cushioning property, and non-slip property was desired.

Patent Document 1: JP-A-2000-102629
Patent Document 2: JP-A-11-093081
Patent Document 3: JP-A-2003-117026
Patent Document 4: U.S. Pat. No. 4,991,842
Patent Document 5: U.S. Pat. No. 5,518,234
Patent Document 6: U.S. Pat. No. 6,024,661

DISCLOSURE OF THE INVENTION

In view of the above circumstances, it is an object of the present invention to provide a ball which has sufficient surface abrasion resistance, excellent cushioning property, and excellent non-slip property, and which can be suitably used for basketball, handball, rugby ball, or American football.

The inventors of the present invention have conducted extensive studies for attaining the above-described object, and have found that the object can be attained by forming a cover layer having substantially continuos pebbles and specific valleys formed on a surface of a base fabric, to thereby complete the present invention.

That is, the present invention provides the following:

(1) A ball used for any one of basketball, handball, rugby ball, and American football, comprising a sheet having formed thereon a cover layer including substantially continuous pebbles and hemispherical valleys adjoining the pebbles formed on a surface of a base fabric, wherein: a height difference between the pebbles and the valleys is 50 to 1,000 μm, a vertical projected area of each of the adjoining valleys is 3 to 30 $mm^2$, and an average distance between the valleys is 0.5 to 3 mm;

(2) A ball according to the above item (1), wherein the cover layer is formed of an elastic polymer;

(3) A ball according to the above item (2), wherein the elastic polymer is in a porous form;

(4) A ball according to the above item (1) or (2), wherein a total area of the vertical projected areas of the valleys accounts for 30 to 60% of a surface area of the sheet;

(5) A ball according to the above item (1) or (2), wherein at least a part of a pebble surface and a valley surface is covered with a non-slip resin;

(6) A ball according to the above item (1) or (2), wherein the base fabric is a leather-like base fabric formed of a fiber-entangled fabric and a polymer; and (7) A ball according to the above item (1) or (2), wherein the base fabric has a thickness of 0.4 to 3.0 mm.

The ball of the present invention has a sheet having formed thereon a cover layer including substantially continuous pebbles and specific hemispherical valleys adjoining the pebbles formed on a surface of a base fabric. Thus, the ball of the present invention has sufficient surface abrasion resistance, excellent cushioning property of the substantially continuous pebbles for reducing impact on fingertips in catching of the ball, and excellent non-slip property. Therefore, the ball of the present invention can be suitably used as a basketball, handball, rugby ball, or American football.

THE MOST PREFERRED EMBODIMENTS TO CARRY OUT THE INVENTION

A cover layer having substantially continuous pebbles on a surface of a base fabric is formed on a sheet constituting the ball of the present invention. The cover layer is preferably formed of an elastic polymer. Here, the phrase "substantially continuous pebbles" refers to a surface state in which the pebbles are formed on a periphery of depressed shapes (valleys) transferred by pressing a plurality of protruded shapes from the surface side at intervals on a flat sheet surface, for example.

A method of forming a sheet having "substantially continuous pebbles" may employ any known method as long as the desired pattern of pebbles and valleys can be provided stably. For example, the method of forming a sheet having "substantially continuous pebbles" may employ: a method involving embossing of a surface of a cover layer formed of an elastic polymer on a surface of a base fabric by using an emboss roller or the like having the desired pattern of pebbles and valleys; and a method involving formation of an elastic polymer layer by casting and solidifying an elastic polymer liquid on release paper having the desired pattern of pebbles and valleys, and use of the elastic polymer layer as a surface layer for the sheet having "substantially continuous pebbles".

It is important that hemispherical valleys formed adjoining the pebbles (hereinafter, may simply be abbreviated as valleys) each have a vertical projected area of 3 to 30 $mm^2$, and that an average distance between the valleys is 0.5 to 3 mm. In addition, it is important that a height difference between the pebbles and the valleys is 50 to 1,000 μm. Examples of a method of forming the valleys include: a method involving formation of the protruded shapes by using an emboss roller; and a method involving formation of protruded shapes by using a flat emboss plate having a similar shape or release paper. However, the method involving the use of the flat emboss plate is not suitable for mass production. The method involving the use of the release paper provides a height difference between the pebbles and valleys substantially limited to 200 to 300 μm. The pattern of pebbles and valleys tends to lack sharpness with a height difference close to the limit. In order to improve the sharpness, the release paper must be pressed at a larger pressing force, and a texture of the sheet tends to be harder. Thus, of those, a method involving formation of the protruded shapes by using an emboss roller is preferable.

When predetermined pebbles are formed by using an emboss roller, the pebbles may be formed by arbitrarily setting conditions such as an emboss depth of the roller to be used, a roller temperature, an embossing pressure, and embossing time. The conditions are not particularly limited, but the desired embossed depth may be obtained by adjusting: the emboss depth of the roller within a range of 80 to 1,100 μm; the roller temperature within the range of 150 to 180° C.; the embossing pressure within the range of 5 to 50 kg/cm; and the embossing time within the range of 10 to 120 seconds.

A ball according to the present invention, that is, a ball to be used in a ball game such as a basketball, handball, rugby ball, or American football in which a ball is grasped by a hand is generally produced by sewing together a plurality of pieces formed of natural leather, synthetic leather, or the like, or by attaching together a plurality of pieces to a core material of the ball. Here, parts where outer peripheries of the individual pieces are brought into contact with each other form streaks or seams. However, the pebbles and valleys on the sheet surface in the present invention refer not to streaks or seams formed on peripheries of the pieces, but refer to a pattern formed on surfaces of the pieces. The pebbles and valleys include no gas filling port generally present on a surface of a gas filling-type ball, and no logos locally formed on the surface of the ball.

A surface pattern of a ball used for a ball game such as a basketball must at least allow fingertips to be in contact with pebbles when a player grasps the ball randomly. Thus, as the pattern of the ball surface, a height difference between the pebbles and the hemispherical valleys formed adjoining the pebbles is 50 to 1,000 μm, preferably 70 to 500 μm. When the height difference is less than 50 μm, favorable non-slip property is hardly provided because a force of the fingertips is dispersed uniformly over the surface of the ball when the ball is grasped by a palm. When the height difference exceeds 1,000 μm, favorable non-slip property is provided, but abrasion resistance of the ball may be reduced. In the present invention, the phrase "height difference between the pebbles and the valleys" refers to a value obtained by: measuring height differences between the highest part of the pebbles and the deepest part of the hemispherical valleys adjoining the pebbles at 10 points from cross section photographs; and averaging the measured values of the 10 points.

Further, in the sheet of the present invention, a vertical projected area of each of the valleys is 3 to 30 $mm^2$, preferably 5 to 20 $mm^2$. When the vertical projected area exceeds 30 $mm^2$, favorable non-slip property is provided, but abrasion resistance of the ball may be reduced. When the vertical projected area is less than 3 $mm^2$, favorable non-slip property is hardly provided because the number of pebbles grasped by a fingertip increases and a force of the fingertip is dispersed uniformly over the surface of the ball when the ball is grasped by a palm. In the present invention, the phrase "vertical projected area of each of the valleys" refers to a vertical projected area of a valley region surrounded by boundaries with respect to the sheet surface. In a pattern including hemispherical valleys and continuous pebbles observed in a cross section of the sheet, a boundary between a pebble and a valley refers to a part at an angle of 45° to a normal of the sheet surface if the pattern is curved, or refers to a corner if the pattern has corners.

A total area of vertical projected areas of the valleys is preferably 30 to 60%, more preferably 40 to 50% as a ratio with respect to a surface area of the sheet. When the total area of the valleys is less than 30% as a ratio, favorable non-slip property is hardly provided because the area and number of valleys grasped by a fingertip decrease when the ball is grasped by a palm. In contrast, when the total area of the valleys exceeds 60% as a ratio, favorable non-slip property is provided, but abrasion resistance of the ball may be reduced. Here, the ratio of the total area of the vertical projected areas of the valleys with respect to the surface area of the sheet is obtained as a ratio per unit area by measuring vertical projected areas of the hemispherical valleys with an electron microscope.

Further, it is important that the valleys each have a hemispherical shape. Here, the term "hemispherical" refers not to a perfect hemispherical shape, but refers to a substantially hemispherical shape. The "hemispherical" shape in the present invention is preferably a three-dimensional shape having a smaller volume formed by cutting a sphere at a face not passing the center of the sphere. The valleys each have such a hemispherical shape, to thereby provide not only the durability and abrasion resistance of the three-dimensional shape itself which cannot be obtained with a non-hemispherical shape but also favorable non-slip property by fitting to the shape of the fingertip.

Further, the average distance between the hemispherical valleys of the present invention must be 0.5 to 3 mm. When the average distance is less than 0.5 mm, softness, cushioning property, feel, and surface abrasion resistance may deteriorate because the valleys are too close to each other, to provide a partly, excessively sharp pebble pattern. When the average distance exceeds 3 mm, fitting property and non-slip property may deteriorate. The average distance between the valleys is preferably 1 to 2 mm.

The phrase "average distance between the valleys" refers to an average of values obtained by: photographing the surface with an electron microscope; selecting arbitrary 10 valleys; and measuring the shortest distance between the adjacent valleys from outer periphery of the valleys. A boundary between a pebble and a valley refers to a part at an angle of 45° to a normal of the sheet surface if the pattern is curved as described above, or refers to a corner if the pattern has corners, and part surrounded by the boundaries is referred to as outer periphery.

Coloring treatment may be performed before or after the embossing treatment. In consideration of possible discoloration during the embossing treatment, the coloring treatment is preferably performed before the embossing treatment. Pigments are most preferably used as colorants from the viewpoints of heat resistance, light resistance, and fastness to rubbing. The coloring treatment may be performed through methods such as a gravure method, a dyeing method, a reverse coating method, and a direct coating method. The coloring treatment is most preferably performed through a gravure method from the viewpoints of productivity, cost, and the like.

In the present invention, the non-slip property may be further enhanced as required through, for example: a method involving application of a non-slip resin over at least a part of continuous pebbles and valleys; or a method involving constitution of at least a part of pebbles and valleys with a non-slip resin. Preferable examples of the non-slip resin include: a resin obtained through homopolymerization or block copolymerization of a rubber-based monomer such as butadiene or isoprene; a solvent-type polymer such as an acrylic polymer obtained through homopolymerization or block copolymerization of an acrylic monomer or a urethane-based polymer; and an emulsion-type polymer. Other types of polymers may be used in combination with resins providing non-slip property.

Furthermore, a known tackiness agent such as a polyterpene resin or a petroleum-based hydrocarbon resin may be added to the non-slip resin. Further, the non-slip property may be adjusted by adding inorganic or organic particles, powder, or the like. Further, a softening agent, fillers, an antioxidant, and the like may be added to a surface resin in such amounts that surface abrasion resistance is not reduced.

Various methods may be used for a method of covering the pebbles on the sheet surface with a non-slip resin. The pebbles alone are preferably covered with a non-slip resin through a method involving selective application of the non-slip resin. A specific example thereof is a method involving transfer of a non-slip resin by using a gravure roller. Both the pebbles and valleys are covered with a non-slip resin through a method involving application of the non-slip resin over the entire surface. Specific examples thereof include: a method involving application of a non-slip resin through spray coating; a method involving coating of a non-slip resin at a constant thickness over the entire surface through knife coating or the like; a method involving application of a non-slip resin over the entire surface of a base material such as process paper for film formation and bonding of the film onto a base material layer through an adhesive layer; and a method involving uniform extrusion of a non-slip resin over a base material from an extruder through an extrusion die for film formation on the surface thereof.

The sheet constituting the ball of the present invention has the cover layer formed on a surface of a base fabric such as natural leather, knitted woven fabric, or nonwoven fabric.

Examples of the base fabric which can be used for the sheet of the present invention include various base fabrics such as natural leather, knitted woven fabric, and nonwoven fabric. When the knitted woven fabric, nonwoven fabric, or the like is used as a base fabric, the base fabric may be impregnated with an elastic polymer as required. Any known leather-like sheets may be used as the base fabric. Of those, a leather-like base fabric formed of a fiber-entangled fabric and an elastic polymer is preferable, and a base fabric having a three-dimensionally entangled nonwoven fabric, which is used as a fiber-entangled fabric, impregnated with a spongy elastic polymer is particularly preferable. This is because valleys adjoining the continuous pebbles on the sheet surface fit well with the fingertips grasping a ball, and the sheet surface has soft touch and texture, and cushioning property to a certain extent, to thereby improve the non-slip property.

Any known natural fiber, synthetic fiber, or semisynthetic fiber may be used as a fiber constituting the knitted woven fabric, nonwoven fabric, or the like used as a base fabric, as long as mechanical properties required for a surface material of a ball can be satisfied. Industrially known cellulose-based fiber, acrylic fiber, polyester-based fiber, polyamide-based fiber, or a mixture thereof is preferably used from the viewpoints of quality stability, cost, and the like. In the present invention, though not particularly limited, a microfine fiber capable of realizing a soft texture similar to that of natural leather is preferable. A microfine fiber having an average fineness of 0.3 dtex or less, more preferably 0.1 dtex or less, and 0.0001 dtex or more is preferably used.

Examples of a method of forming microfine fibers described above include: (a) a method involving direct spinning of microfine fibers having an intended average fineness; and (b) a method involving spinning of microfine fiber-forming fibers having a fineness larger than the intended fineness, and then conversion of the microfine fiber-forming fibers into microfine fibers having the intended average fineness.

In the method (b) of forming microfine fibers by way of microfine fiber-forming fibers, the microfine fibers are generally formed by composite spinning or mix spinning two or more types of incompatible thermoplastic polymers. Then, at least one polymer component of the fibers is removed through extraction or decomposition, or polymers are segmented or split along a boundary between the component polymers. Typical examples of the microfine fiber-forming fibers from which at least one polymer component is removed include so-called "sea/island fibers" and "multi-layered fibers".

In the sea/island fibers, a sea component polymer is removed through extraction or decomposition, and in the multi-layered fibers, at least one layer component polymer is removed through extraction or decomposition, to thereby obtain microfine fiber bundles formed of the remaining island component. Typical examples of the microfine fiber-forming fibers segmented or split along the boundary between the component polymers include so-called petal-like layered fibers and multi-layered fibers, which are split from each other along the boundary between layers of different polymers into microfine fiber bundles through physical treatment or chemical treatment.

The island component polymer for the sea/island fibers or multi-layered fibers is preferably a polymer which can be subjected to melt spinning and is capable of exhibiting sufficient fiber physical properties such as strength. The island component polymer preferably has a melt viscosity higher than that of the sea component polymer under spinning conditions and a large surface tension. Examples of the island component polymer described above include: polyamide-based polymers such as nylon-6, nylon-66, nylon-610, and nylon-612; polyamide-based copolymers thereof; polyester-based polymers such as polyethylene terephthalate, polypropylene terephthalate, polytrimethylene terephthalate, and polybutylene terephthalate; and polyester-based copolymers thereof.

The sea component polymer for the sea/island fibers or multi-layered fibers is preferably a polymer which has a melt viscosity lower than that of the island component polymer, exhibits dissolution and decomposition behaviors different from those of the island component, has a high solubility in a solvent, a decomposer, or the like used for dissolving or removing the sea component, and has a low compatibility with the island component. Examples of the sea component polymer suitably used include polyethylene, modified polyethylene, polypropylene, polystyrene, modified polystyrene, and modified polyester.

The microfine fiber-forming fibers for suitably forming microfine fibers having a fineness of 0.3 dtex or less, that is, the sea/island fibers have a suitable sea/island volume ratio (sea component/island component) of 30/70 to 70/30, and preferably 40/60 to 60/40. When the volume ratio of the sea component is less than 30%, the resulting leather-like sheet is hardly sufficiently flexible because the amount of the sea component to be removed through dissolution or decomposition by using a solvent or decomposer is too small, thus requiring the use of a treating agent such as a softening agent in an excess amount. However, the use of an excess amount of the treating agent is not preferable because it may cause various problems such as deterioration in mechanical properties such as tear strength, adverse effects on other treating agents, adverse effects on touch, and poor durability. When the volume ratio of the sea component exceeds 70%, the resulting leather-like sheet hardly has stably ensured mechanical properties at a sufficient level for a base material for a ball because the absolute amount of the fibers formed of the island component obtained after removal through dissolution or decomposition is too small. In addition, a large amount of the component to be removed through dissolution or decomposition may cause problems such as variation in quality due to removal failure, and disposal of removed components in large amounts. Further, a large amount thereof is not appropriate from the viewpoint of productivity with respect to production speed, production cost, or the like, and thus is not industrially desirable.

A method of producing the three-dimensionally entangled nonwoven fabric suitably used as a fiber-entangled fabric is not particularly limited, and the three-dimensionally entangled nonwoven fabric can be produced through any known method providing appropriate weight or density for a base material for a ball. Examples of the fabric to be used include: nonwoven fabric formed of staples; and nonwoven fabric formed of filaments. A method of forming a web may employ any known methods such as carding, paper-making, and spun-bonding. The web is entangled through a known method such as needle-punching or spun-lacing alone or in combination.

Of the methods, the three-dimensionally entangled nonwoven fabric is particularly preferably produced through the following method. Spun fibers are drawn at a draw ratio of about 1.5 to 5 times, mechanically crimped, and then cut into staples of about 3 to 7 cm long each. The staples are then carded and formed into a web having a desired density by passing through a webber. The obtained web is laminated to have a desired weight and needle-punched at about 300 to 4,000 punches/cm$^2$ by using a single- or multi-barb needle to entangle fibers in a thickness direction.

Next, the obtained fiber-entangled fabric such as the three-dimensionally entangled nonwoven fabric is impregnated with an elastic polymer as required. The fiber-entangled fabric is impregnated with a solution or dispersion of the elastic polymer through any known method such as dip-nipping, knife-coating, bar-coating, roll-coating, and spray-coating alone or in combination, and then the elastic polymer is dry- or wet-coagulated into a spongy form having numerous voids.

Any known elastic polymers generally used for production of a leather-like sheet may be used as the elastic polymer. Preferable examples of the elastic polymer include a polyurethane-based resins, a polyester-based elastomer, a rubber-based resin, a polyvinyl chloride resin, a polyacrylic acid-based resin, a polyamino acid-based resin, a silicon-based resin, modified products thereof, copolymers thereof, and mixtures thereof.

The elastic polymer in an aqueous dispersion or organic solution is impregnated into the fiber-entangled fabric, and is coagulated into a spongy form mainly through dry-coagulation for the aqueous dispersion or through wet-coagulation for the organic solution. When the aqueous dispersion is used, a heat-sensitive gelling agent is preferably added, to thereby allow uniform coagulation of the elastic polymer in a thickness direction through dry-coagulation, or through dry-coagulation combined with steaming, far infrared heating, or the like. When the organic solution is used, a coagulation modifier is preferably used in combination, to thereby form more uniform voids. The elastic polymer impregnated into the fiber-entangled fabric, especially the three-dimensionally entangled nonwoven fabric, is coagulated into a spongy form, to thereby obtain a base material having a natural leather-like texture and various physical properties suitable for a material for a ball.

In the present invention, a polyurethane-based resin is preferably used as the elastic polymer impregnated into the fiber-entangled fabric from the viewpoints of a well-balanced texture and well-balanced physical properties of the resulting fiber-entangled fabric in a composite state.

Typical examples of the polyurethane-based resin are those produced through a reaction in a predetermined molar ratio of: at least one polymer diol having an average molecular weight of 500 to 3,000 selected from the group consisting of polyester diol, polyether diol, polyester ether diol, polylactone diol, and polycarbonate diol; at least one organic diisocyanate selected from the group consisting of aromatic, alicyclic, and aliphatic organic diisocyanates such as tolylene diisocyanate, xylene diisocyanate, phenylene diisocyanate, 4,4'-diphenylmethane diisocyanate, 4,4'-dicyclohexylmethane diisocyanate, isophorone diisocyanate, and hexamethylene diisocyanate; and at least one chain extender selected from the group consisting of low molecular compounds having at least two active hydrogen atoms such as diols, diamines, hydroxylamines, hydrazines, and hydrazides. Polyurethane may be used as a mixture of two or more types thereof, or may be used as a polymer composition obtained by adding a polymer such as synthetic rubber, polyester elastomer, or polyvinyl chloride as required.

When the microfine fiber-forming fibers are used as the fiber, a composite sheet obtained after impregnation and coagulation of the solution or dispersion of the elastic polymer, or a fiber sheet before impregnation and coagulation of the solution or dispersion of the elastic polymer is subjected to microfine fiber formation. Thus, the microfine fiber-forming fibers are converted into microfine fiber bundles, to thereby obtain a leather-like base fabric formed of the microfine fiber-entangled fabric and the elastic polymer. When the composite sheet, in particular, the sea/island fiber is subjected to microfine fiber formation, the sea component polymer is removed to form voids between microfine fiber bundles and the elastic polymer to weaken the binding of the microfine fiber bundles by the elastic polymer. Thus, the leather-like base fabric tends to have a softer texture. Therefore, the composite sheet (after impregnation and coagulation of the elastic polymer) is preferably subjected to microfine fiber formation in the present invention.

In contrast, when the fiber sheet is subjected to microfine fiber formation, the microfine fiber bundles are strongly bound by the elastic polymer and the leather-like base fabric tends to have a harder texture. However, the tendency of having a harder texture can be sufficiently suppressed by reducing the ratio of the elastic polymer in the leather-like base fabric. Therefore, the fiber sheet (before impregnation and coagulation of the elastic polymer) is preferably subjected to microfine fiber formation for obtaining dense and hard texture with a higher ratio of fibers.

The thickness of the base fabric for a surface material of a ball, for example, may be arbitrarily selected in accordance with the type or required physical properties of the ball, the texture of the ball preferred by a player, and the like. The thickness thereof is preferably 0.4 to 3.0 mm, though not particularly limited thereto. When the thickness of the base fabric is less than 0.4 mm, minimum essential mechanical properties such as tensile strength, tear strength, and abrasion resistance may be hardly ensured. In contrast, when the thickness of the base fabric exceeds 3.0 mm, there are no particular disadvantages in mechanical properties as a material, and cushioning property tends to rather improve. However, the thickness exceeding 3.0 mm is not preferable because the weight of the ball itself increases.

The mass ratio of the fibers to the elastic polymer in the base fabric may be arbitrarily selected for adjusting physical properties or texture, and is not particularly limited in the essential significance of the present invention. For example, a base fabric having a generally preferred leather-like texture as a material for a ball has a mass ratio of fibers/elastic polymer of generally 35/65 to 65/35, preferably 40/60 to 60/40 when the composite sheet is subjected to microfine fiber formation, or a mass ratio thereof of generally 65/35 to 95/5, preferably 60/40 to 90/10 when the fiber sheet is subjected to microfine fiber formation.

Various methods can be employed for forming a cover layer formed of an elastic polymer on the surface of the base fabric. An example of the method involves: continuous application of a dispersion, solution, or melt of an elastic polymer onto a surface of a base fabric in an amount determined by a predetermined clearance between the surface of the base fabric and a knife, bar, roller, or the like; and drying of the elastic polymer into a film form or dry-coagulation of the elastic polymer into a porous form and drying, wet-coagulation of the elastic polymer into a porous form and drying, or melt formation.

In the present invention, when continuous pebbles are formed on an elastic polymer cover layer by using an emboss roller, flat emboss plate, or the like, the elastic polymer layer is preferably in a porous form obtained through dry- or wet-coagulation and drying. Alternatively, when continuous pebbles are formed on an elastic polymer cover layer by transfer using release paper, the elastic polymer layer is preferably dry- or wet-coagulated and dried from the viewpoint of surface touch and texture, though not particularly limited thereto. When a dispersion is used, a coagulation and drying method generally involves: use of an additive such as a foaming agent; and successive dry-coagulation and drying. When a solution is used, a coagulation and drying method generally involves: application of a treating agent containing a poor solvent of an elastic polymer, or immersion in a treating bath containing a poor solvent of an elastic polymer; and coagulation of the elastic polymer into a porous form.

When the base fabric formed of a fiber-entangled fabric and an elastic polymer is used as the base fabric, a method of simultaneously completing coagulation of an elastic polymer to be impregnated into a base fabric and coagulation of an elastic polymer for forming a cover layer is preferably employed in the present invention. Thus, the drying after the coagulation can be performed in one step, and the base fabric and the elastic polymer cover layer (porous surface layer) are integrally bonded in the obtained leather-like sheet.

Another method of forming the elastic polymer cover layer on the surface of the base fabric involves: application of a predetermined amount of dispersion or solution of an elastic polymer on a transfer sheet such as a film or release paper once; drying of the elastic polymer into a film form, or coagulation of the elastic polymer into a porous form and drying in the same manner as described above; integrally bonding the obtained film to the base fabric through an adhesive, or through re-dissolution by using a treating liquid containing a solvent of the elastic polymer; and peeling off the transfer sheet. Still another method thereof involves: application of a predetermined amount of dispersion or solution of an elastic polymer onto a transfer sheet once; and attaching of the transfer sheet with a base fabric before or during the drying and coagulation of the elastic polymer, to thereby integrally bond the elastic polymer layer and the base fabric upon coagulation.

The elastic polymer forming a cover layer is preferably a resin capable of providing non-slip property to some extent, not a resin having slip property as a resin itself. Examples of the resin that can be used include synthetic rubber, polyester elastomer, polyvinyl chloride, and a polyurethane-based resin. Of those, a polyurethane-based resin is preferably used as the elastic polymer impregnated into the fiber-entangled fabric from the viewpoint of a balance among elasticity, softness, abrasion resistance, ability of forming a porous form, and the like.

Various polyurethane-based resins as described above may be used as the polyurethane-based resin. Polyurethane may be used as a mixture of two or more types thereof, or may be used as a polyurethane polymer composition obtained by adding a polymer such as synthetic rubber, polyester elastomer, or polyvinyl chloride as required. As polyurethane mainly used, a resin formed of polyether-based polymer diol represented by polytetramethylene glycol is preferably used from the viewpoints of hydrolysis resistance, elasticity, and the like.

The solution or dispersion of the elastic polymer to be applied onto the base fabric may arbitrarily include an additive such as a colorant, a light stabilizer, or a dispersant alone or in combination of two or more types thereof added in accordance with the purpose. Other additives such as a coagulation modifier for wet-coagulation may be arbitrarily selected as required and preferably added alone or in combination of two or more types thereof to control the porous form, in addition to the foaming agent for dry foaming.

When polyurethane is used as the elastic polymer, a solution containing polyurethane as a main ingredient is applied onto the base fabric and the whole is immersed in a treating bath containing a poor solvent of polyurethane, to thereby coagulate polyurethane into a porous form. Water is preferably used as a typical poor solvent of polyurethane. However, a good solvent of polyurethane such as dimethylformamide is mixed with water which is a poor solvent as a treating bath, and a mixing ratio thereof is arbitrarily set, to thereby allow control of a coagulated state, that is, a porous form or pattern and result in a preferably employed method.

The ball of the present invention has substantially continuos pebbles on the surface, and thus has sufficient surface abrasion resistance, excellent cushioning property, and excellent non-slip property. Formation of predetermined valleys adjoining the pebbles provides an excellent fitting effect of a hand grasping a ball, to thereby further improve the non-slip property. Therefore, the ball of the present invention can be suitably used as a ball for basketball, handball, rugby ball, or American football.

EXAMPLES

Next, the present invention will be described more specifically by way of examples, but the present invention is not limited to the examples. In the examples, "parts" and "%" represent "parts by mass" and "mass %" respectively, unless otherwise noted.

Non-slip property, cushioning property, and abrasion resistance test assuming collision with the ground such as in dribbling in the following examples and comparative examples were evaluated as described below.

[Non-slip property]

Whether a ball of the present invention is slippery or not compared with a conventional basketball (Comparative Example 1) was evaluated by 10 arbitrarily selected basketball players.

[Cushioning property]

Whether impact in catching a ball of the present invention is stronger or weaker compared with that a conventional basketball (Comparative Example 1) was evaluated by 10 arbitrarily selected basketball players.

[Abrasion resistance test assuming collision with ground such as in dribbling]

A ball was thrown at plywood 1.6 m away at a speed of 37 km/hour and an angle of incidence of 60° for 20,000 times, and then a surface state of the ball was observed and evaluated as described below.

Level causing no problems in practical use: no surface peel and no significant dirt observed Level causing problems in practical use: surface peel or significant dirt in a vicinity of an air filling port or ball surface observed

Example 1

Nylon-6 (island component) and high-fluidity low-density polyethylene (sea component) were melt-spun into sea/island mix-spun fibers (sea component/island component ratio=50/50). The obtained fibers were drawn, crimped, and then cut into 51 mm long staples each having a fineness of 3.5 denier. The staples were carded and formed into a web through a cross-lapping method to be laminated. A stack of webs was needle-punched at a needling density 980 P/cm$^2$ by using single-barbed felt needles, to thereby obtain a nonwoven fabric having a mass per unit area of 450 g/m$^2$. The nonwoven fabric was dried under heating, pressed to smooth its surface, and impregnated with a 16% dimethylformamide (hereinafter, referred to as "DMF") solution of polyether-based polyurethane, followed by the coagulation of the impregnated polyurethane in an aqueous solution of DMF. Then, the nonwoven fabric was washed with hot water, and polyethylene in the fibers was extracted and removed by hot toluene, to thereby obtain a synthetic leather-like base fabric formed of nylon-6 microfine fibers and porous polyurethane and having a thickness of 1.2 mm.

A DMF solution (solid content: 20%) of polyether-based polyurethane (MP-105, available from Dainippon Ink & Chemicals, Inc.) was applied onto the surface of the synthetic leather-like base fabric in an amount of 400 g/m$^2$ and coagulated in water, to thereby form an elastic polymer layer in a porous form. The elastic polymer layer was colored with an ether-based polyurethane ink containing a brown pigment, and was embossed at a temperature of 170° C., a pressure of 10 kg/cm, and an emboss speed of 1 m/minute by using an emboss roller having hemispherical pebbles each with a height of 1 mm and a projected area from an upper surface of 8 mm$^2$, to thereby obtain a cover layer. The obtained pattern of pebbles and valleys had comparable height differences between the continuous pebbles and hemispherical valleys adjoining the pebbles at any position, and an average height difference of 400 μm. The obtained pattern had comparable vertical projected areas of valleys, that is, projected areas of valleys from the upper surfaces which are perpendicular to the sheet surface for any valley, and an average vertical projected area of 7 mm$^2$. Further, the obtained pattern of pebbles and valleys had an average distance between the valleys of 1.5 mm, and the total area of the projected areas of the valleys accounted for 40% of the projected area of the entire sheet. Next, the only upper surfaces of the resultant pebbles were colored through a gravure method by using an ether-based polyurethane ink prepared by adding to a color colored in advance carbon black to change a color tone of the ink to a darker (black) color.

A basketball covered with the thus-obtained sheet was produced, and was used in a basketball game. As a result, the basketball of Example 1 had excellent non-slip property compared with that of a conventional basketball (Comparative Example 1) due to catching of the pebbles. Further, as cushioning property of the pebbles, the basketball of Example 1 had significantly reduced impact on fingertips in catching of a ball compared with that of the conventional basketball. The basketball of Example 1 had appropriate properties for adults as well as for children having undeveloped fingertips, in particular, which could not be realized with the conventional basketball. Further, the basketball of Example 1 had favorable non-slip property even after use over a long period of time.

Example 2

A DMF solution (solid content: 7%) of polycarbonate-based polyurethane (U-5811, available from Seikoh Chem. Co., Ltd.) as a resin providing non-slip property was applied in 2-stages onto pebbles on the surface of the sheet produced in Example 1 having colored upper surfaces by using a gravure roll of 150 mesh, followed by drying at 130° C.

A basketball was produced by using the thus-obtained sheet in the same manner as in Example 1 and used. As a result, the basketball of Example 2 had cushioning property comparable to that of Example 1 and better non-slip property than that of Example 1, and had further excellent properties for children generally having lower grip strength than adults.

Example 3

A sheet was obtained in the same manner as in Example 1 except that: height difference between the continuous pebbles and hemispherical valleys adjoining the pebbles were comparable at any position, and an average height difference was 80 μm; vertical projected areas of valleys, that is, projected areas of valleys from the upper surfaces which are perpendicular to the sheet surface were comparable for any valley, and an average vertical projected area was 4 $mm^2$; an average distance between the valleys was 2.5 mm; and the total area of the projected areas of the valleys accounted for 31% of the projected area of the entire sheet. Next, the only upper surfaces of the resultant pebbles were colored through a gravure method by using an ether-based polyurethane ink prepared by adding to a color colored in advance to change a color tone of the ink to a darker (black) color.

A basketball covered with the thus-obtained sheet was produced, and was used in a basketball game. As a result, the basketball of Example 3 had excellent non-slip property compared with that of a conventional basketball (Comparative Example 1) due to catching of the pebbles. Further, as cushioning property of the pebbles, the basketball of Example 3 had significantly reduced impact on fingertips in catching of a ball compared with that of the conventional basketball. The basketball of Example 3 had appropriate properties for adults as well as for children having undeveloped fingertips, in particular, which could not be realized with the conventional basketball. Further, the basketball of Example 3 had favorable non-slip property even after use over a long period of time.

Example 4

A sheet was obtained in the same manner as in Example 1 except that: height differences between the continuous pebbles and hemispherical valleys adjoining the pebbles were comparable at any position, and an average height difference was 850 μm; vertical projected areas of valleys, that is, projected areas of valleys from the upper surfaces which are perpendicular to the sheet surface were comparable for any valley, and an average vertical projected area was 25 $mm^2$; and an average distance between the valleys was 0.7 mm. Next, the only upper surfaces of the resultant pebbles were colored through a gravure method by using an ether-based polyurethane ink prepared by adding to a color colored in advance to change a color tone of the ink to a darker (black) color.

A basketball covered with the thus-obtained sheet was produced, and was used in a basketball game. As a result, the basketball of Example 4 had excellent non-slip property compared with that of a conventional basketball (Comparative Example 1) due to catching of the pebbles. Further, as cushioning property of the pebbles, the basketball of Example 4 had significantly reduced impact on fingertips in catching of a ball compared with that of the conventional basketball. The basketball of Example 4 had appropriate properties for adults as well as for children having undeveloped fingertips, in particular, which could not be realized with the conventional basketball. Further, the basketball of Example 4 had favorable non-slip property even after use over a long period of time.

Comparative Example 1

A sheet was produced in the same manner as in Example 1 except that an emboss roller was used to provide a pattern of pebbles and valleys generally used for a basketball, that is: a diameter of about 1.8 mm, numerous hemispherical protrusions with a height difference of about 200 μm at a distance about of 0.5 mm; and without substantially continuous pebbles. A basketball having the thus-obtained sheet on a surface was produced, and was used. The basketball of Comparative Example 1 had poor cushioning property and had large impact on fingertips in catching of the ball. The basketball of Comparative Example 1 could be used by adults but was not appropriate for children, and was slippery compared to the basketball of Example 1.

Comparative Example 2

A sheet was produced in the same manner as in Example 1 except that an emboss speed was 4 m/minute, a height difference between continuous pebbles and the valleys adjoining the pebbles was 30 μm, and a vertical projected area of the valleys was 2.5 $mm^2$. A basketball having the thus-obtained sheet on a surface thereof was produced, and was used. The basketball of Comparative Example 2 had poor cushioning property and had large impact on fingertips in catching of the ball as in Comparative Example 1. The basketball of Comparative Example 2 could be used by adults but was not appropriate for children, and was slippery compared to the basketball of Example 1.

Comparative Example 3

A sheet was produced in the same manner as in Example 1 except that a vertical projected area of the valleys adjoining the continuous pebbles was 50 $mm^2$. A basketball having the thus-obtained sheet on a surface thereof was produced, and was used. The basketball of Comparative Example 3 had favorable cushioning property, but the results of abrasion resistance test assuming collision with the ground such as in dribbling indicated that the basketball was at a level causing problems in practical use. The basketball of Comparative Example 3 was slippery compared to the basketball of Example 1.

Comparative Example 4

A sheet was produced in the same manner as in Example 1 except that an average distance between the valleys adjoining the continuous pebbles was 0.4 mm. A basketball having the thus-obtained sheet on a surface thereof was produced, and was used. The basketball of Comparative Example 4 had favorable cushioning property, but poor softness, cushioning property, and feel. The results of abrasion resistance test assuming collision with the ground such as in dribbling indicated that the basketball was at a level causing problems in practical use.

Comparative Example 5

A sheet was produced in the same manner as in Example 1 except that an average distance between the valleys adjoining the continuous pebbles was 3.7 mm. A basketball having the thus-obtained sheet on a surface thereof was produced, and was used. The results of abrasion resistance test assuming collision with the ground such as in dribbling indicated that the basketball of Comparative Example 5 was at a level causing no problems in practical use. The basketball of Comparative Example 5 had favorable softness but poor fitting property and non-slip property. The basketball of Comparative Example 5 was slippery compared to the basketball of Example 1.

Comparative Example 6

A sheet was produced in the same manner as in Example 1 except that the shape of the valleys adjoining the continuous pebbles was changed to a cylinder. A basketball having the thus-obtained sheet on a surface thereof was produced, and was used. The basketball of Comparative Example 6 had favorable non-slip property but poor softness, cushioning property, and feel. The results of abrasion resistance test assuming collision with the ground such as in dribbling indicated that the basketball of Comparative Example 6 was at a level causing problems in practical use.

Comparative Example 7

A sheet was produced in the same manner as in Example 1 except that the shape of the outer periphery of the valleys adjoining the continuous pebbles was changed to a hexagon. A basketball having the thus-obtained sheet on a surface thereof was produced, and was used. The basketball of Comparative Example 7 had favorable non-slip property but poor softness, cushioning property, and feel. The results of abrasion resistance test assuming collision with the ground such as in dribbling indicated that the basketball of Comparative Example 7 was at a level causing problems in practical use.

INDUSTRIAL APPLICABILITY

The ball of the present invention includes substantially continuous pebbles and specific hemispherical valleys adjoining the pebbles on a surface of a base fabric, and has sufficient surface abrasion resistance, excellent cushioning property of substantially continuous pebbles for reducing impact on fingertips in catching of the ball, and excellent non-slip property. Therefore, the ball of the present invention can be suitably used as a basketball, handball, rugby ball, or American football.

The invention claimed is:

1. A ball used for any one of basketball, handball, rugby ball, and American football, comprising a sheet having formed thereon a cover layer including continuous pebbles and hemispherical valleys adjoining the pebbles formed on a surface of a base fabric, wherein: a height difference between the pebbles and the valleys is 50 to 1,000 μm, a vertical projected area of each of the adjoining valleys is 3 to 30 $mm^2$, and an average distance between the valleys is 0.5 to 3 mm.

2. A ball according to claim 1, wherein the cover layer is formed of an elastic polymer.

3. A ball according to claim 2, wherein the elastic polymer is in a porous form.

4. A ball according to claim 1, wherein a total area of the vertical projected areas of the valleys accounts for 30 to 60% of a surface area of the sheet.

5. A ball according to claim 1, wherein at least a part of a pebble surface and a valley surface is covered with a non-slip resin.

6. A ball according to claim 1, wherein the base fabric is a leather-like base fabric formed of a fiber-entangled fabric and a polymer.

7. A ball according to claim 1, wherein the base fabric has a thickness of 0.4 to 3.0 mm.

* * * * *